US006420957B1

(12) United States Patent
Harada

(10) Patent No.: US 6,420,957 B1
(45) Date of Patent: Jul. 16, 2002

(54) ELECTRIC PART HAVING SOLDER-LESS TERMINAL METAL FITMENT

(75) Inventor: Susumu Harada, Toyama (JP)

(73) Assignee: Hokuriku Electric Industry Co., LTD, Toyama (JP)

( * ) Notice: Subject to any disclaimer, the term of this patent is extended or adjusted under 35 U.S.C. 154(b) by 0 days.

(21) Appl. No.: 09/582,004

(22) PCT Filed: Oct. 20, 1999

(86) PCT No.: PCT/JP99/05788

§ 371 (c)(1),
(2), (4) Date: Jun. 19, 2000

(87) PCT Pub. No.: WO00/24011

PCT Pub. Date: Apr. 27, 2000

(30) Foreign Application Priority Data

Oct. 20, 1998 (JP) ..... 10-298094

(51) Int. Cl.[7] ..... H01C 10/32
(52) U.S. Cl. ..... 338/162; 338/199; 338/184
(58) Field of Search ..... 338/160, 162, 338/118, 176, 184, 199; 361/736, 738

(56) References Cited

U.S. PATENT DOCUMENTS 5,877,673 A 3/1999 Kotani et al. ..... 338/162
5,920,252 A * 7/1999 Nakagawa ..... 338/160
5,933,070 A * 8/1999 Hasebe et al. ..... 338/162
5,986,537 A * 11/1999 Kato ..... 338/68

FOREIGN PATENT DOCUMENTS

| | | |
|---|---|---|
| JP | 8124726 | 5/1996 |
| JP | 9027408 | 1/1997 |
| JP | 10189301 | 7/1998 |

OTHER PUBLICATIONS

Internationational Search Report for PCT/JP99/05788 dated Feb. 1, 2000.

* cited by examiner

*Primary Examiner*—Karl D. Easthom

(57) ABSTRACT

An electric component capable of attaining connection of two kinds of connection conductors thereto and electrically connecting an electrode arranged on a front surface of a circuit board and a terminal fitment to each other without soldering. A terminal fitment (129) is integrally formed by subjecting a metal plate to machining. The terminal fitment 19 includes a first conductor holding section 129A, a second conductor holding section 129B and a contact terminal section 129C. The contact terminal section 129C is constructed to as to exhibit elastic or resilient force sufficient to force a contact portion 129*s* against the contact electrode E2 while being kept arranged between the first conductor holding section 129A and the front surface of the circuit board 102.

11 Claims, 4 Drawing Sheets

ELECTRIC PART HAVING SOLDER-LESS TERMINAL METAL FITMENT

TECHNICAL FIELD

This invention relates to an electric component with a soldering-less terminal fitment, and more particularly to an electric component equipped with a terminal fitment which permits electrical connection without soldering and a high-voltage variable resistor unit.

BACKGROUND ART

Use of freon is subject to restriction in view of environmental pollution, thus, it is required to connect a terminal conductor, a lead wire or the like to a connection electrode on a circuit board without soldering. This is likewise true of a high-voltage electric component called a focus pack used for adjusting a focus voltage of a cathode ray tube (CRT), a screen voltage thereof or the like.

U.S. Pat. No. 4,471,339 discloses a high-voltage variable resistor including a terminal connection structure for connecting, by means of a terminal fitment like a coiled spring provided at one end thereof with a ring through which a connection conductor or connection terminal is inserted, a connection electrode of the resistor to the connection terminal without soldering.

Also, U.S. Pat. No. 5.546,280 issued to the assignee which corresponds to Japanese Patent Application No. 318669/1994 discloses two kinds of terminal connection structures each constructed so as to connect a core of a lead wire to a connection electrode on a circuit board without soldering.

U.S. Pat. No. 5,546,280 described above also discloses a connection structure having an integral terminal fitment which is integrally provided with a conductor holding section and an elastic or resilient contact terminal section incorporated therein. The terminal fitment is so constructed that the resilient contact terminal section connects the conductor holding section and the electrode arranged on the circuit board to each other without soldering. Further, the patent discloses a structure for connecting a plurality of electrodes on the circuit board and a plurality of connection conductors to each other without soldering.

U.S. Pat. No. 5,508,678 which corresponds to Japanese Patent Application No. 67099/1994 discloses a high-voltage variable resistor which includes such an integral terminal fitment as described above and an insulating casing having a board receiving chamber defined therein and covered with a lid member.

The assignee proposed a soldering-less connection structure having a terminal assembly incorporated therein which includes a terminal fitment including two conductor holding sections and a conductive coiled spring arranged between the terminal fitment and an electrode on a circuit board, as disclosed in Japanese Patent Application Laid-Open Publication No. 189316/1998 (Japanese Patent Application No. 350137/1996). Now, an electric component disclosed in the Japanese publication will be described with reference to FIGS. 3A to 4, wherein FIG. 3A shows a conventional electric component or high-voltage variable resistor unit, FIG. 3B shows an insulating casing, FIG. 3C is a sectional view taken along line C—C of FIG. 3A and FIG. 4 shows a circuit board. The high-voltage variable resistor proposed includes an insulating casing 1 integrally made of an insulating resin material and a circuit board 3 made of a ceramic material. The circuit board 3 is formed on a front surface thereof with a variable resistance circuit pattern including an input electrode E1, a focus voltage output electrode E2, a screen voltage output electrode E3, a ground electrode or earth electrode E4, a focus voltage adjusting resistance element R1, a screen voltage adjusting resistance element R2 and the like. The circuit board 3 has through-holes H1, H2 and H3 formed at a central portion of the input electrode E1, the ground electrode E4 and the focus voltage output electrode E2 to which a capacitor is connected, respectively. The through-holes H1, H2 and H3 have an input connection conductor 61, a ground connection conductor and a capacitor connection conductor 59 inserted thereinto, respectively.

The insulating casing 1, as best seen in FIG. 38, is formed at one end thereof or a bottom end thereof with an opening. The insulating casing 1 is formed therein with a board receiving chamber 5, a fixed resistance substrate receiving chamber 6 and a capacitor receiving chamber 7. The fixed resistance substrate receiving chamber 6 and capacitor receiving chamber 7 are arranged so as to communicate with each other. The insulating casing 1 includes a double outer peripheral wall structure constituted by an inner wall 9 and an outer wall 11 each formed into a closed loop-like configuration. The inner wall 9 and outer wall 11 are arranged so as to define a rectangular ring-like fit groove 13 therebetween. The outer wall 11 has a wall portion 11*a* arranged along the capacitor receiving chamber 7, which functions as a partition wall for separating the board receiving chamber 5 and capacitor receiving chamber 7 from each other. The inner wall 9 Is provided on an inner surface thereof with a rib 15 which acts as a board support rib for supporting the circuit board 3 thereon. The circuit board 3 is interposedly supported between the rib 15 and a board contact rib of a cover or lid member 51 described hereinafter. When the lid member 51 is not provided with the board contact rib, the circuit board 3 may be joined to the rib 15 by means of an adhesive. The opening of the insulating casing 1 is formed with an opening-side peripheral wall 17, which is arranged so as to surround the opening except one side thereof. The peripheral wall 17 is fitted in a fit groove formed on a casing of a fly-back transformer.

The inner wall 9 of the insulating casing 1 which defines the board receiving chamber 5 is formed thereon with four terminal fitment fit sections 19, 21, 23 and 25. The terminal fitment fit sections 19 and 21 include a terminal fitment 29 which is arranged in correspondence to the focus voltage output electrode E2 and a terminal fitment 29 which is arranged in correspondence to the screen voltage output electrode E3 fitted therein, respectively. In the prior art, the terminal fitment fit sections 19, 21, 23 and 25 each have the terminal fitment 29 which is formed into the same configuration fitted therein. The terminal fitment fit sections 19, 21, 23 and 25 are provided on a portion thereof facing the opening with coil spring receiving portions 19A, 21A, 23A and 25A for receiving coiled springs 30 therein, respectively.

The insulating casing 1 is provided on an upper wall thereof with four expansions 31, 33, 35 and 37 in correspondence to the terminal fitment fit sections 19, 21, 23 and 25, respectively. The expansions 31 and 33 each constitute a connection conductor inserting portion into which a connection conductor such as a pin terminal, a lead wire or the like is inserted. The expansions 31 and 33 are formed with through-holes 39 and 42, respectively. Between the Inner wall of the insulating casing 1 which defines the board receiving chamber 5 and the front surface of the circuit board 3 is defined a space in which two slide elements are rotatable received. In FIG. 3A, reference numerals 43 and 45 each designate an operation shaft rotatable extending through the upper wall of the insulating casing 1 so that the slide element may be operated from an outside of the insulating casing 1.

The fixed resistance substrate receiving chamber 6, as shown in FIG. 3B, has a so-called bleeder resistance 47 received therein. The bleeder resistance 47 is interposedly supported between two holding portions 49 and 50 provided in the fixed resistance substrate receiving chamber 6 so as to vertically extend therein.

The board receiving chamber 5, as shown in FIG. 3C, is closed with a lid member 51 made of a synthetic resin material substantially identical with or similar to that for the insulating casing 1. The lid member 51 is formed on a rear surface thereof with a recess 53, in which a capacitor C electrically connected to the focus voltage output electrode E2 is partially received. The lid member 51 is arranged so as to close an opening of the board receiving chamber 5 while keeping a front surface thereof facing a rear surface of the variable resistance circuit board 3. The lid member 51, as shown in FIG. 5 which shows a focus voltage output section, is formed with a through-hole 51*a* via which a capacitor connection conductor 59 is inserted and a through-hole via which an input connection conductor or a ground connection conductor is inserted.

The terminal fitment 29, as shown in FIG. 9. includes a first conductor holding section 29A and a second conductor holding 29B for interposedly holding the connection conductors, which are arranged so as to intersect each other at a substantially right angle. The first conductor holding section 29A includes four biting elements of a triangular shape arranged so as to be separated from each other and bite into an outer periphery of the connection conductor 59 inserted therethrough. The biting elements each are constructed so as to readily deeply bite into the outer periphery of the connection conductor 59 when drawing force is applied to the connection conductor 59 inserted through the first conductor holding section 29A. The second conductor holding section 29B likewise includes four biting elements adapted to bite into an outer periphery of a connection conductor 65 which is a core of an insulating covered wire 63 through which a focus voltage is outputted. Thus, the connection conductor 65 acts as a connection conductor through which a focus voltage is outputted.

The first conductor holding section 29A of the terminal fitment 29 has an end of the capacitor connection conductor or first connection conductor held therein and the second conductor holding section 29 has an end of the core 65 of the lead wire 63 held therein. The terminal fitment 29 and coiled spring 30 cooperate with each other to constitute a terminal assembly and the coiled spring functions as a conductor contact member. The coiled spring 30 is made by forming a conductive wire into a spiral configuration by working. The coiled spring 30 is so arranged that the conductive wire spirally surrounds a periphery of the capacitor connection conductor 59 and is compressed between the focus voltage output electrode E2 and the first conductor holding section 29A of the terminal fitment 29.

The connection structure shown in FIG. 5 requires arrangement of the coiled spring 30, to thereby cause the number of parts required and the number of steps In assembling of the structure to be increased, leading to an increase in manufacturing cost. Also, it fails to permit the coiled spring 30 to be received in the coiled spring receiving portion 19A of the terminal fitment fit section 19 at a correct posture during the assembling, leading to a deterioration in yields.

DISCLOSURE OF INVENTION

The present invention has been made in view of the foregoing disadvantage of the prior art.

Accordingly, it is an object of the present invention to provide an electric component which is capable of attaining connection of two kinds of connection conductors thereto.

It is another object of the present invention to provide an electric component which is capable of electrically connecting an electrode arranged on a circuit board and a terminal fitment to each other without soldering while reducing the number of parts.

It is a further object of the present invention to provide an electric component which is capable of ensuring reliable contact between an electrode arranged on a circuit board and a contact of a terminal fitment even when the terminal fitment is integrally formed.

It is still another object of the present invention to provide a high-voltage variable resistor which is capable of electrically connecting an electrode arranged on a circuit board and a terminal fitment to each other without soldering while reducing the number of parts.

It is yet another object of the present invention to m provide a high-voltage variable resistor which is capable of ensuring reliable contact between an electrode arranged on a circuit board and a contact of a terminal fitment even when the terminal fitment is integrally formed.

It is a still further object of the present invention to provide a high-voltage variable resistor which is capable of being assembled while reducing the number of steps In assembling thereof.

In accordance with the present invention, an electric component is provided. The electric component includes a circuit board formed with a through-hole via which a first connection conductor is inserted from a side of a rear surface of the circuit board and provided on a front surface thereof with a circuit pattern Including a contact electrode formed in proximity to an opening of the through-hole, an insulating casing including a board receiving chamber formed on one surface thereof with an opening and a connection conductor introducing section formed on a wall thereof defining the board receiving chamber so as to introduce an end of a second connection conductor into the board receiving chamber from an outside, and a terminal fitment arranged between the circuit board arranged in the board receiving chamber of the Insulating casing so as to keep the front surface of the circuit board facing an interior of the board receiving chamber and the wall of the board receiving chamber. The terminal fitment is integrally formed of a metal plate by machining. The terminal fitment includes a first conductor holding section for interposedly holding an end of the first connection conductor fitted in a terminal fitment fit section formed at the wall of the insulating casing and inserted into the board receiving chamber via the through-hole, a second conductor holding section for interposedly holding the end of the second connection conductor inserted from the connection conductor introducing section into the board receiving chamber, and a contact terminal section including a contact portion positioned between the first conductor holding section and the contact electrode on the front surface of the circuit board and contacted with the contact electrode. The contact terminal section of the terminal fitment is constructed so as to exhibit elastic force sufficient to force the contact portion against the contact electrode while being arranged between the first conductor holding section and the contact electrode on the front surface of the circuit board.

Thus, the present invention permits the terminal fitment to be contacted with the contact electrode without requiring any coiled spring, resulting In reducing the number of parts to be incorporated and decreasing the number of steps in manufacturing of the electric component.

The first and second conductor holding sections may be constructed in any desired manner. Also, the contact terminal section may be configured as desired.

In a preferred embodiment of the present invention, the terminal fitment may be constructed so that the first conductor holding section includes a first plate-like portion arranged so as to face the front surface of the circuit board and formed with a plurality of slits. The first conductor holding section also includes a plurality of biting elements formed between the slits and arranged so as to hold the first connection conductor and bite into the first connection conductor due to application of drawing force to the first connection conductor. The second conductor holding section of the terminal fitment includes a second plate-like portion formed with a plurality of slits. The second plate-like portion has the second connection conductor inserted therethrough in a direction parallel to that in which two ends of the first plate-like portion are arranged so as to be spaced from each other. The second plate-like portion is arranged so as to vertically extend from one of the ends of the first plate-like portion positioned forwardly on the basis of the direction of insertion of the second connection conductor through the second conductor holding section in a direction distant from the circuit board. The second conductor holding section of the terminal fitment further includes a plurality of biting elements defined between the slits of the second plate-like portion so as to interposedly hold the second connection conductor and bite into the second connection conductor due to application of drawing force to the second connection conductor. The contact terminal section of the terminal fitment includes a base portion connected to the other end of the first plate-like portion positioned rearwardly on the basis of the direction of insertion of the second connection conductor through the second conductor holding section. The contact portion of the contact terminal section is positioned forwardly as compared with the other end of the first plate-like portion on the basis of the direction of insertion of the second connection conductor through the second conductor holding section.

Such construction of the terminal fitment simplifies a structure of the terminal fitment and facilitates both assembling and manufacturing thereof. Further, it prevents upward displacement or inclination of the contact portion of the contact terminal section from the contact electrode due to displacement or inclination of the second conductor holding section by application of force to the terminal fitment when the second connection conductor is inserted through the second conductor holding section, resulting in minimizing a failure in contact between the contact portion and the contact electrode.

In a preferred embodiment of the present invention, the contact terminal section of the terminal fitment may be arranged so that the contact portion is positioned forwardly as compared with the one end of the first plate-like portion on the basis of the direction of insertion of the second connection conductor through the second conductor holding section. Such configuration permits force sufficient to urge or force the contact portion against the contact electrode to effectively act on the contact terminal section upon inclination of the second conductor holding section by application of force to the terminal fitment when the second connection conductor is inserted through the second conductor holding section, resulting in positively preventing a failure in contact between the contact portion and the contact electrode.

In a preferred embodiment of the present invention, the contact terminal section is preferably formed at a portion thereof positioned between the first conductor holding section and the contact portion with a through-hole for inserting the first connection conductor therethrough (hereinafter referred to as "conductor through-hole") which permits the first connection conductor having the end held by the first conductor holding section to be inserted therethrough without being contacted therewith. Such configuration permits a width of the contact terminal section to be increased to a degree In spite of arrangement of the first connection conductor, to thereby increase mechanical strength of the contact terminal section and elastic or resilient force thereof. Also, insertion of the first connection conductor via the conductor through-hole while keeping the first connection conductor from being contacted with the conductor through-hole ensures that the contact terminal section satisfactorily generates resilient force while keeping the first connection conductor from interfering with deformation of the contact terminal section. More specifically, the contact terminal section may include a pair of arms arranged so as to be spaced from each other with the conductor through-hole being interposed therebetween, and a curved portion arranged so as to connect the arms to each other therethrough and constitute the contact portion. Thus, a suitable variation in length and/or width of the conductor through-hole formed between the arms permits resilient force of the contact terminal section to be suitably set.

In a preferred embodiment of the present intention, the contact portion may be provided with at least one biting element which bites into the contact electrode. This prevents removal of the contact portion from the contact electrode during assembling of the electric component.

The present invention may be commonly applied to a variety of electric components. In particular, application of the present invention to a high-voltage variable resistor reduces the number of steps in manufacturing of the resistor, to thereby significantly contribute to cost-savings of the resistor.

BEST MODES FOR CARRYING OUT INVENTION

Now, an electric component according to the present invention will be described hereinafter with reference to FIGS. 1 to 2D.

Figure 1:
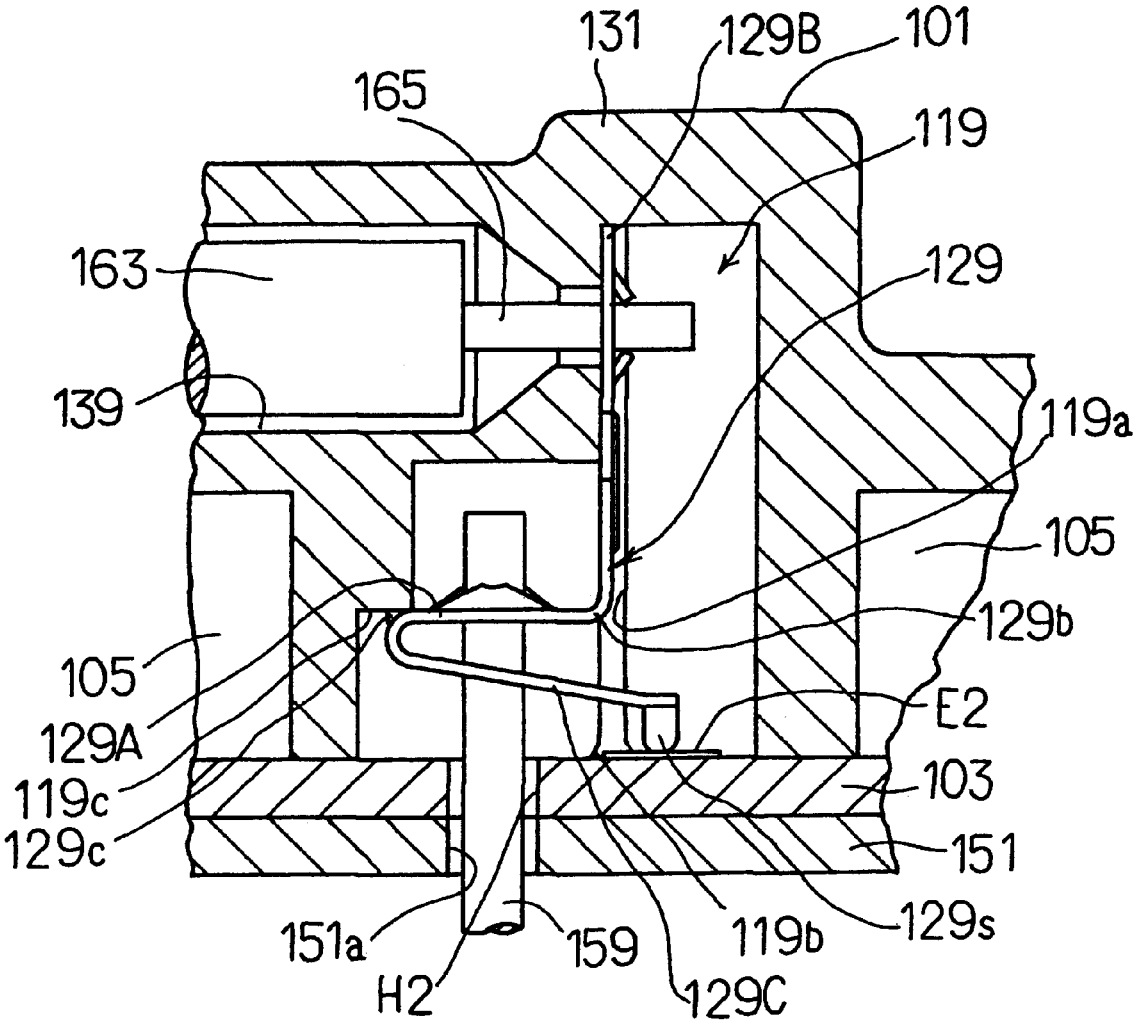
FIG. 1 is a fragmentary enlarged sectional view showing an embodiment of an electric component according to the present invention, which is applied to a focus voltage output section of a high-voltage variable resistor.
Figure 2A:
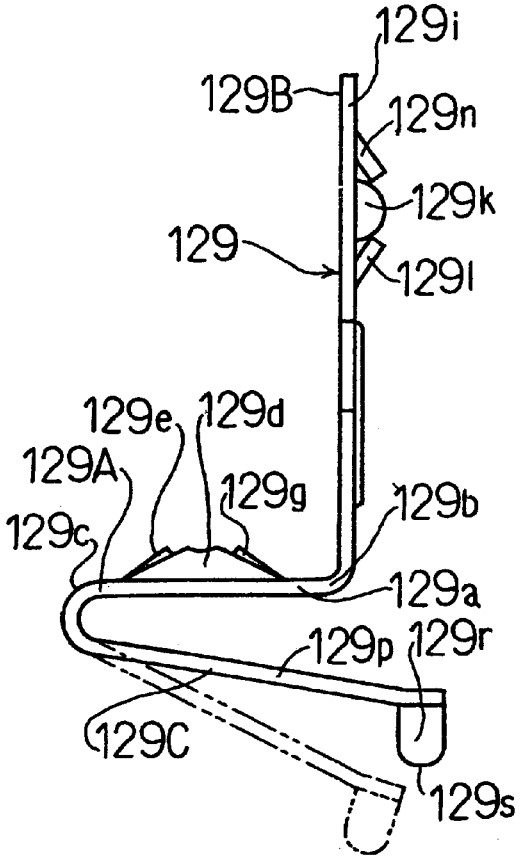
FIG. 2A is a front elevation view showing a terminal fitment incorporated in the electric component of FIG. 1.
Figure 2B:
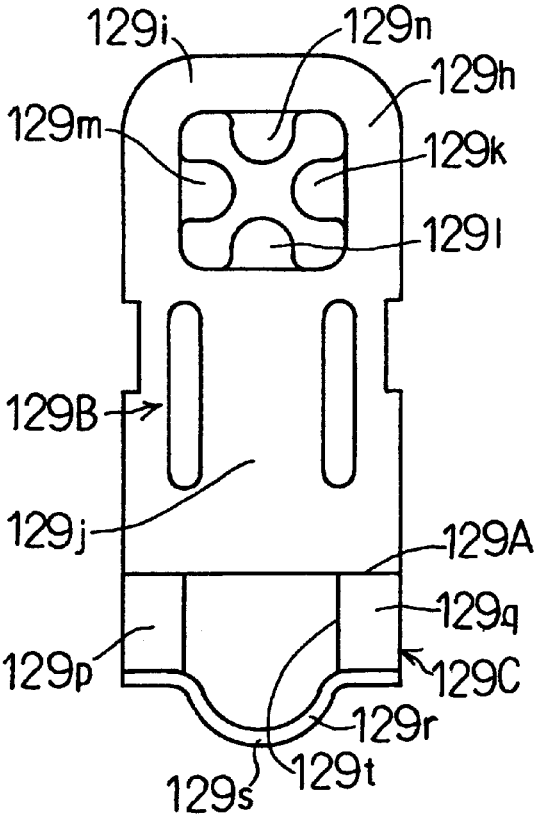
FIG. 2B is a right side view of the terminal fitment shown in FIG. 2A.
Figure 2C:
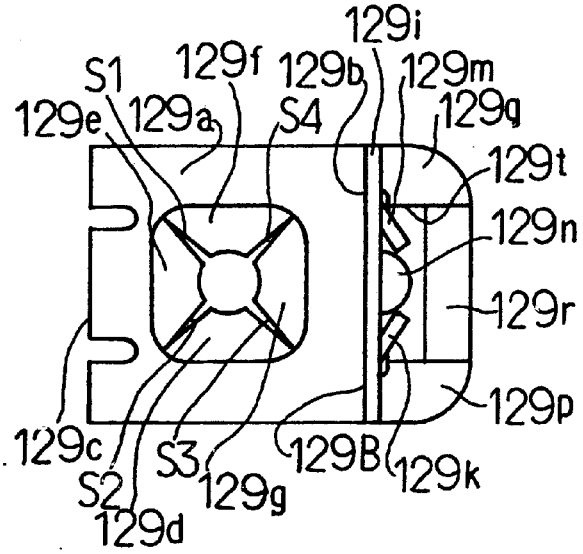
FIG. 2C is a plan view of the terminal fitment shown in FIG. 2A.
Figure 2D:
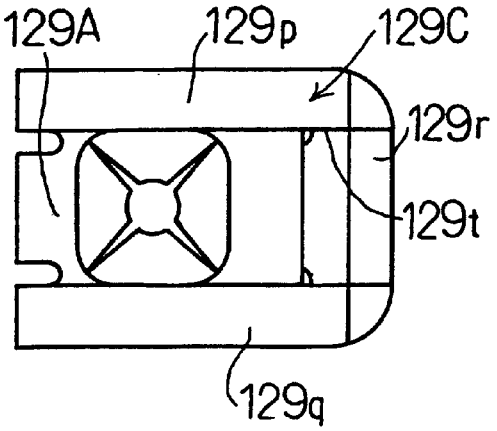
FIG. 2D is a bottom view of the terminal fitment shown in FIG. 2A.
Figure 3A:
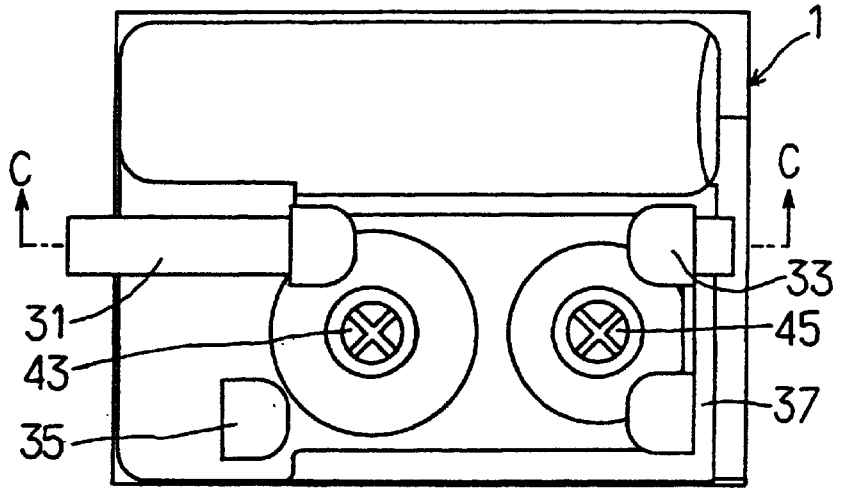
FIG. 3A is a plan view showing a conventional high-voltage variable resistor.
Figure 3B:
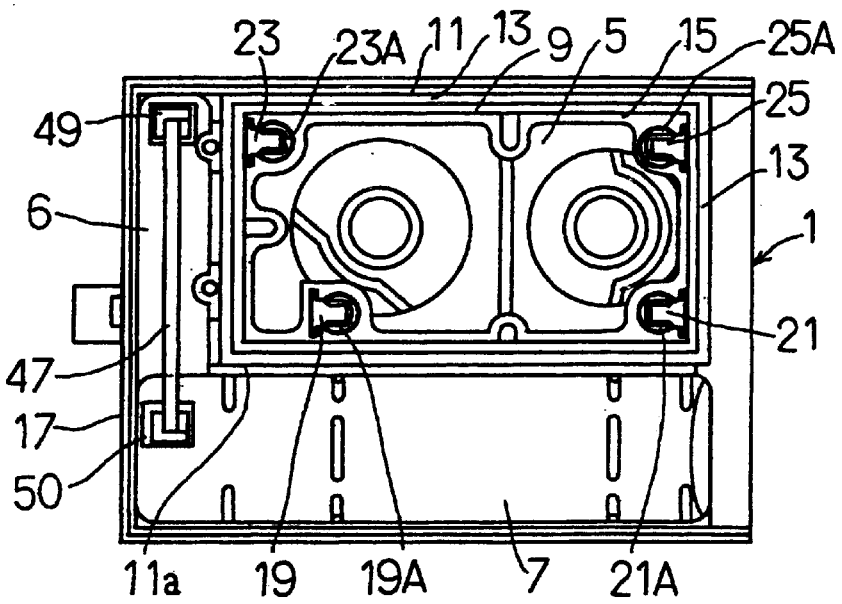
FIG. 3B is a bottom view showing an insulating casing incorporated in the high-voltage variable resistor of FIG. 3A.
Figure 3C:
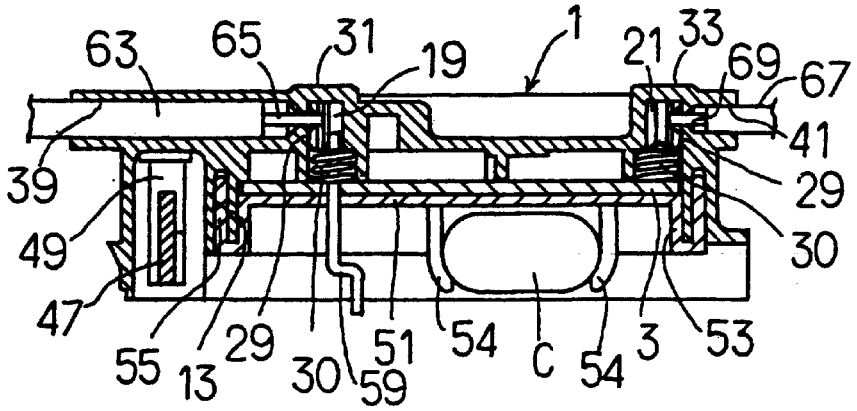
FIG. 3C is a sectional view taken along line C—C of FIG. 3A.
Figure 4:
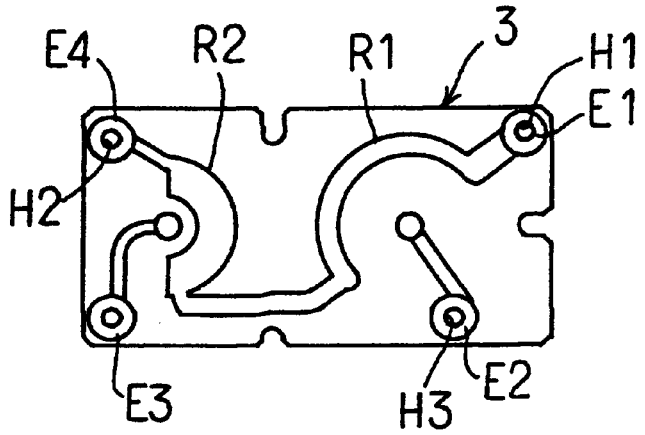
FIG. 4 is a schematic view showing a front surface of a circuit board incorporated in the high-voltage variable resistor of FIG. 3A.
Figure 5:
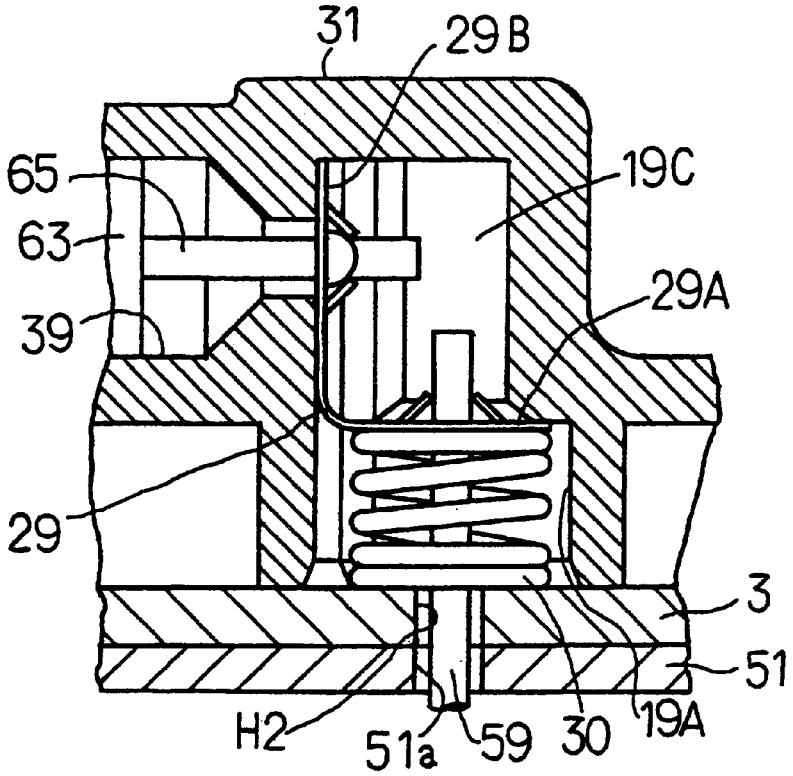
FIG. 5 is a fragmentary sectional view showing a conventional focus voltage output section.

Referring first to FIG. 1, an embodiment of an electric component according to the present invention is illustrated, which is applied to a focus voltage output section of the conventional high-voltage resistor described above with reference to FIG. 3. Thus, reference numerals in FIG. 1 correspond to those discussed in FIGS. 3A to 5, except with an additional prefix of 100.

In FIG. 1, reference numeral 101 designates an insulating casing integrally formed of an insulating resin material such as Noryl (trademark) resin, polybutylene terephthalate or the like. 103 is a circuit board which is made of a ceramic material and formed on a front surface thereof with a variable resistance circuit pattern including an input electrode, a focus voltage output electrode E2, a screen voltage output electrode, a ground electrode or earth electrode, a focus voltage adjusting resistance, a screen voltage adjusting resistance and the like. Thus, the illustrated embodiment may be constructed in substantially the same manner as the prior art described above with reference to FIGS. 3A to 3C, except a terminal fitment 129 and a terminal fitment fit section 119 in which the terminal fitment 129 is fitted.

Now, the terminal fitment 129 will be described with reference to FIGS. 2A to 2D, which are a front elevation view of the terminal fitment 129, a right-side elevation view thereof, a plan view thereof and a bottom view thereof. The terminal fitment 129 is formed by subjecting a conductive metal sheet or plate which is made of stainless steel, phosphor bronze or the like and pressed into a predetermined configuration to bending. The terminal fitment is constructed so as to attain connection of connection conductors thereto without soldering. The conductive metal plate preferably exhibits elastic or resilient characteristics to a degree by bending and may be made of a stainless steel sheet or plate of 0.1 to 0.4 mm in thickness, a phosphor bronze sheet or plate of 0.2 to 0.5 mm in thickness or the like. The terminal fitment 129 includes a first conductor holding section 129A and a second conductor holding section 129B which are arranged so as to be substantially perpendicular to each other. The terminal fitment 129 also includes a contact terminal section 129C arranged below the first conductor holding section 129A.

The first conductor holding section 129A includes a first plate-like portion 129*a*. The plate-like portion 129*a* is formed into a rectangular shape and includes a first end 129*b* connected to the second conductor holding section 129B and a second end 129*c* connected to the contact terminal section 129C. The first plate-like portion 129*a* is formed with four slits S1 to S4 in a manner to radially extend from a center thereof. Between the respective adjacent two of the slits S1 to S4 are arranged four biting elements 129*d*, 129*e*, 129*f* and 129*g* of a triangular shape which are adapted to bite into an outer periphery of a connection conductor (first connection conductor) 159 inserted through the first conductor holding section 129A. The biting elements 129*d* to 129*g* are arranged so as to be inclined in a direction in which the conductor is inserted through the conductor holding section 129A. The biting elements 129*d* to 129*g* each are formed at a distal end thereof with an arcuate recess or depression, so that application of drawing force to the connection conductor 159 inserted through the conductor holding section 129A permits the biting elements to readily deeply bite into the outer periphery of the connection conductor, resulting in removal of the connection conductor from the conductor holding section 129A being effectively prevented.

The second conductor holding section 129B Includes a second plate-like portion 129*h* arranged so as to extend in a direction perpendicular to the first plate-like portion 129*a*. The second plate-like portion 129*h* has a connection conductor (second connection conductor) 165 inserted therethrough in a direction parallel to that in which the ends 129*b* and 129*c* of the first plate-like portion 129*a* are arranged so as to be spaced from each other. The second plate-like portion 129*h* is arranged so as to vertically extend from one of the ends 129*b* and 129*c* of the first plate-like portion 129 positioned forwardly on the basis of the direction of insertion of the connection conductor 165 through the second conductor holding section 129B or from the first end 129*b* of the first plate-like portion 129*a* in a direction distant from the circuit board 103. The second plate-like portion 129*h* includes a rectangular portion 129*i* of a substantially rectangular shape and an elongated connection portion 129*j*. The rectangular portion 129*i* is formed with four biting elements 129*k*, 129*l*, 129*m* and 129*n* by pressing in such a manner that slits of a large size may be defined between respective adjacent two of the biting elements 129*k* to 129*n*. The biting elements 129*k* to 129*n* are arranged so as to be inclined in the direction in which the connection conductor 165 is inserted through the second conductor holding section 129B. The biting elements 129*k* to 129*n* are constructed so as to prevent the connection conductor 165 from being cut by the biting elements when rotational force is applied to the connection conductor. More particularly, the biting elements 129*k* to 129*n* each have a distal end projected while being arcuately rounded. The biting (a elements 129*d* to 129*g* described above each are formed at a distal end thereof with two acute corners. On the contrary, the above-described configuration of the biting elements 129*k* to 129*n* prevents such acute corners from being formed on the biting elements 129*k* to 129*n*. Such construction of the biting elements 129*k* to 129*n* prevents cutting of the connection conductor 165 even when the connection conductor 165 is rotated about a center thereof while being holding by the biting elements 129*k* to 129*n*. In spite of the fact that the distal end of each of the biting elements 129*k* to 129*n* is curvedly or roundedly projected, application of drawing force to the connection conductor 165 permits the biting elements 129*k* to 129*n* to securely bite into the outer periphery of the connection conductor 165 because the biting elements 129*k* to 129*n* each are formed on each of both ends thereof defined in a thickness direction thereof with an angular corner.

The contact terminal section 129C includes a proximal portion or base portion connected to the other or second end 129*c* of the first plate-like portion 129*a* positioned rearwardly on the basis of the direction of insertion of the second connection conductor 165 through the second conductor holding section 129B. Also, the contact terminal section 129C includes a contact portion 129*s* positioned forwardly as compared with the other or second end 129*c* of the first plate-like portion 129*a* on the basis of the direction of insertion of the second connection conductor 165 through the second conductor holding section 129B. More particularly, the contact terminal section 129C includes a pair of arms 129*p* and 129*q* arranged so as to be spaced from each other with a conductor through-hole 129*t* of an elongated shape being interposed therebetween and a curved portion 129*r* arranged so as to connect the arms 129*p* and 129*q* to each other therethrough and constitute the contact portion 129*s*. The contact portion 129*s* of the contact terminal section 129C is positioned forwardly as compared with the one end 129*b* of the first plate-like portion 129*a* on the basis of the direction of insertion of the second connection conductor 165 through the second conductor holding section 129B or positioned outside the one end 129*b* of the first flat-plate portion 129*a*. The conductor through-hole 129*t* is arranged so as to be positioned between the first conductor holding section 129A and the contact portion 129*s* and constructed so as to permit the first connection conductor 159 having the end held by the first conductor holding section 129A to be inserted therethrough without being contacted therewith.

In FIG. 1, reference numeral 163 designates an insulating covered lead wire through which a focus voltage is outputted and of which a core constitutes the second connection conductor 165 through which the focus voltage is outputted. The first conductor holding section 129A of the terminal fitment 129 functions to interposedly hold an end of the first connection conductor 159 acting as a capacitor connection conductor and the second conductor holding section 129B functions to interposedly hold the core 165 of the lead wire 163 therein. The contact terminal section 129C of the terminal fitment functions to exhibit resilient force for urging or forcing the contact portion 129*a* against the contact electrode E2 while being arranged between the first conductor holding section 129A and the contact electrode E2 on the front surface of the circuit board 103. The terminal fitment fit section 119 is formed with two fit grooves 119*a* in which edges of the second plate-file portion 129*h* of the second conductor holding section 129B of the terminal fitment defined in a width direction thereof are fitted. In FIG. 1, only one fit groove 119*a* is shown for the sake of brevity. The fit grooves 119*a* each are arranged so as to continuously extend from a side of an opening of the insulating casing 101 to a bottom wall of the insulating casing facing the front surface of the circuit board 103. The fit grooves 119*a* each are formed at an inlet portion thereof with a tapered portion 119*b* for facilitating insertion of both edges of the second plate-like portion 129*h* of the terminal fitment 129 defined in a width direction of the second plate-like portion 129*h* thereinto. For this purpose, the tapered portion 119*b* is formed so as to be enlarged toward the opening of the insulating casing 101. The terminal fitment fit section 119 is formed therein with a step 119*c* for supporting the end 129*c* of the first plate-like portion 129*a* of the first conductor holding section 129A and ends positioned opposite to each other on both sides of the end 129*c* thereon while keeping both edge portions of the second plate-like portion 129*h* of the terminal fitment defined in a width direction of the second plate-like portion fully fitted in the fit grooves 119*a*. The connection conductor 159 is inserted at the end thereof through the conductor through-hole 129*t* formed at the contact terminal section 129C into the first conductor holding section 129A. Such construction prevents the contact terminal section 129C from interfering with insertion of the connection conductor 159 therethrough. Also, when the connection conductor 159 is inserted through the first conductor holding section 129A, the first plate-like portion 119*a* of the first conductor holding section 129A is supported on the step 119*c*, to thereby minimize deformation of the terminal fitment.

Reference numeral 139 designates a through-hole constituting a connection conductor introducing section 139. When the core or second connection conductor 165 inserted from the through-hole 139 via the second conductor holding section 129B, force which acts to incline the second conductor holding section 129B in the direction of insertion of the connection conductor 165 through the second conductor holding section 129B is applied to the terminal fitment 129. Application of such force to the second conductor holding section 129B causes force in a direction of forcing the contact portion 129*s* against the contact electrode E2 to be applied to the contact portion 129*s* of the contact terminal section 129C due to the above-described configuration of the terminal fitment 129. Due to moment, the force is increased with an increase in length of the arms 129*p* and 129*q* of the contact terminal section 129C or an increase in distance by which the contact portion 129*s* is separated from the end 129*b* of the first plate-like portion. In a direction in which the connection conductor 165 is inserted through the second conductor holding section 129B. Thus, the illustrated embodiment effectively prevents a failure in contact between the contact portion 129*s* and the contact electrode E2.

In the illustrated embodiment, the contact portion 129*s* is free of any biting element. However, the contact portion 129*s* may be formed thereon with at least one biting element which is constructed so as to bite into the contact electrode E2 This prevents removal of the contact portion 129*s* from the contact electrode E2 during assembling of the high-voltage variable resistor.

The above description has been made on application of the present invention to a high-voltage variable resistor. However, the present invention may be commonly applied to a variety of electric components which require connection of at least one connection conductor thereto without soldering.

Industrial Applicability

The present invention permits the terminal fitment to be contacted with the contact electrode without requiring any coiled spring, resulting in reducing the number of parts incorporated and decreasing the number of steps in manufacturing of the electric component.

Also, the present invention prevents the contact portion of the contact terminal section from being raised from the contact electrode when the second conductor holding section is inclined due to application of force to the terminal fitment upon insertion of the second connection conductor through the second conductor holding section, to thereby minimize a failure in contact between the contact portion of the contact terminal section and the contact electrode.

What is claimed is:

1. An electric component comprising:

a circuit board formed with a through-hole via which a first connection conductor is inserted from a side of a rear surface of said circuit board and provided on a front surface thereof with a circuit pattern including a contact electrode formed in proximity to an opening of said through-hole;

an insulating casing including a board receiving chamber formed on one surface thereof with an opening and a connection conductor introducing section formed on a wall thereof defining said board receiving chamber so as to introduce an end of a second connection conductor into said board receiving chamber from an outside; and a terminal fitment arranged between said circuit board arranged in said board receiving chamber of said insulating casing so as to keep said front surface of said circuit board facing an interior of said board receiving chamber and said wall of said board receiving chamber;

said terminal fitment being integrally formed of a metal plate by machining;

said terminal fitment including a first conductor holding section for interposedly holding an end of said first connection conductor fitted in a terminal fitment fit section formed at said wall of said insulating casing and inserted into said board receiving chamber through said through-hole, a second conductor holding section for interposedly holding said end of said second connection conductor inserted from said connection conductor introducing section into said board receiving chamber, and a contact terminal section including a contact portion positioned between said first conductor holding section and said contact electrode on said front surface of said circuit board and contacted with said contact electrode;

said contact terminal section of said terminal fitment being constructed so as to exhibit elastic force sufficient to force said contact portion against said contact electrode while being arranged between said first conductor holding section and said contact electrode on said front surface of said circuit board.

2. An electric component as defined in claim 1, wherein said first conductor holding section includes a first plate-like portion arranged so as to face said front surface of said circuit board and formed with a plurality of slits;

said first conductor holding section also includes a plurality of biting elements formed between said slits and arranged so as to hold said first connection conductor and bite into said first connection conductor due to application of drawing force to said first connection conductor;

said second conductor holding section of said terminal fitment includes a second plate-like portion formed with a plurality of slits;

said second plate-like portion having said second connection conductor inserted therethrough in a direction parallel to that in which two ends of said first plate-like portion are arranged so as to be spaced from each other;

said second plate-like portion being arranged so as to vertically extend from one of said ends of said first plate-like portion positioned forwardly on the basis of the direction of insertion of said second connection conductor through said second conductor holding section in a direction distant from said circuit board;

said second conductor holding section of said terminal fitment further includes a plurality of biting elements defined between said slits of said second plate-like portion so as to interposedly hold said second connection conductor and bite into said second connection conductor due to application of drawing force to said second connection conductor; and said contact terminal section of said terminal fitment includes a base portion connected to the other end of said first plate-like portion positioned rearwardly on the basis of the direction of insertion of said second connection conductor through said second conductor holding section;

said contact portion of said contact terminal section being positioned forwardly as compared with said the other end of said first plate-like portion on the basis of the direction of insertion of said second connection conductor through said second conductor holding section.

3. An electric component as defined in claim 2. wherein said contact terminal section of said terminal fitment is arranged so that said contact portion is positioned forwardly as compared with said one end of said first plate-like portion on the basis of the direction of insertion of said second connection conductor through said second conductor holding section.

4. An electric component as defined in claim 3, wherein said contact terminal section is formed at a portion thereof positioned between said first conductor holding section and said contact portion with a conductor through-hole which permits said first connection conductor having said end held by said first conductor holding section to be inserted therethrough without being contacted therewith.

5. An electric component as defined in claim 4, wherein said contact terminal section includes a pair of arms arranged so as to be spaced from each other with said conductor through-hole being interposed therebetween and a curved portion arranged so as to connect said arms to each other therethrough and constitute said contact portion.

6. An electric component as defined in claim 1, wherein said contact portion is provided with at least one biting element biting into said contact electrode.

7. A high-voltage variable resistor comprising:

a circuit board formed with a through-hole through which a first connection conductor is inserted from a side of a rear surface of said circuit board, said circuit board being provided on a front surface thereof with a variable resistor circuit pattern having a plurality of electrodes including at least one contact electrode formed in proximity to an opening of said through-hole;

an insulating casing made of insulating resin material and including a connection conductor introducing section and a board receiving chamber receiving said circuit board and having an opening formed on one surface of the casing, said connection conductor introducing section being formed on a wall defining said board receiving chamber so as to introduce an end of a second connection conductor into said board receiving chamber from an outside;

at least one slide element arranged in a space defined between a front surface of said circuit board and a wall of said insulating casing defining said board receiving chamber and operated from an outside of said insulating casing; and at least one terminal fitment arranged between said circuit board arranged in said board receiving chamber of said insulating casing so as to keep said front surface of said circuit board facing an interior of said board receiving chamber and said wall of said board receiving chamber;

said terminal fitment being integrally formed of a metal plate by machining;

said terminal fitment including a first conductor holding section for interposedly holding an end of said first connection conductor fitted in a terminal fitment fit section formed at said wall of said insulating casing and inserted into said board receiving chamber through said through-hole, a second conductor holding section for interposedly holding said end of said second connection conductor inserted from said connection conductor introducing section into said board receiving chamber, and a contact terminal section including a contact portion positioned between said first conductor holding section and said contact electrode on said front surface of said circuit board and contacted with said contact electrode;

said contact terminal section of said terminal fitment being constructed so as to exhibit elastic force sufficient to force said contact portion against said contact electrode while being arranged between said first conductor holding section and said contact electrode on said front surface of said circuit board.

8. A high-voltage variable resistor as defined in claim 7, wherein said first conductor holding section of said terminal fitment includes a first plate-like portion arranged so as to face said front surface of said circuit board and formed with a plurality of slits;

said first conductor holding section also includes a plurality of biting elements formed between said slits and arranged so as to hold said first connection conductor and bite into said first connection conductor due to application of drawing force to said first connection conductor;

said second conductor holding section of said terminal fitment includes a second plate-like portion formed with a plurality of slits;

said second plate-like portion having said second connection conductor inserted therethrough in a direction parallel to that in which two ends of said first plate-like portion are arranged so as to be spaced from each other;

said second plate-like portion being arranged so as to vertically extend from one of said ends of said first plate-like portion positioned forwardly on the basis of the direction of insertion of said second connection conductor through said second conductor holding section in a direction distant from said circuit board;

said second conductor holding section of said terminal fitment further includes a plurality of biting elements defined between said slits of said second plate-like portion so as to interposedly hold said second connection conductor and bite into said second connection conductor due to application of drawing force to said second connection conductor; and said contact terminal section of said terminal fitment includes a base portion connected to the other end of said first plate-like portion positioned rearwardly on the basis of the direction of insertion of said second connection conductor through said second conductor holding section;

said contact portion of said contact terminal section being positioned forwardly as compared with said the other end of said first plate-like portion on the basis of the direction of insertion of said second connection conductor through said second conductor holding section.

9. A high-voltage variable resistor as defined in claim 8, wherein said contact terminal section of said terminal fitment is arranged so that said contact portion is positioned forwardly as compared with said one end of said first plate-like portion on the basis of the direction of insertion of said second connection conductor through said second conductor holding section.

10. A high-voltage variable resistor as defined in claim 9, wherein said contact terminal section is formed at a portion thereof positioned between said first conductor holding section and said contact portion with a conductor through-hole which permits said first connection conductor having said end held by said first conductor holding section to be inserted there through without being contacted therewith.

11. A high-voltage variable resistor as defined in claim 10, wherein said contact terminal section includes a pair of arms arranged so as to be spaced from each other with said conductor through-hole being interposed therebetween and a curved portion arranged so as to connect said arms to each other there through and constitute said contact portion.

* * * * *